US007225803B2

(12) United States Patent
Boyadjieff

(10) Patent No.: US 7,225,803 B2
(45) Date of Patent: Jun. 5, 2007

(54) PAVEMENT SAW AND VACUUM APPARATUS

(76) Inventor: George I. Boyadjieff, 18772 Colony Cir., Villa Park, CA (US) 91861

( * ) Notice: Subject to any disclaimer, the term of this patent is extended or adjusted under 35 U.S.C. 154(b) by 0 days.

(21) Appl. No.: 11/417,437

(22) Filed: May 3, 2006

(65) Prior Publication Data

US 2006/0249133 A1 Nov. 9, 2006

Related U.S. Application Data

(60) Provisional application No. 60/678,248, filed on May 3, 2005.

(51) Int. Cl.
*B24D 1/04* (2006.01)

(52) U.S. Cl. ..... 125/13.01; 125/13.03; 451/456

(58) Field of Classification Search ..... 125/13.01, 125/13.03; 451/456
See application file for complete search history.

(56) References Cited

U.S. PATENT DOCUMENTS

| | | | | |
|---|---|---|---|---|
| 3,598,446 | A * | 8/1971 | Hatcher | 299/39.2 |
| 5,167,215 | A * | 12/1992 | Harding, Jr. | 125/13.01 |
| 5,215,071 | A * | 6/1993 | Mertes et al. | 125/13.01 |
| 5,564,408 | A * | 10/1996 | Bassols | 125/12 |
| 2005/0279340 | A1 * | 12/2005 | Baratta | 125/12 |
| 2006/0053629 | A1 * | 3/2006 | Martin | 30/123 |

* cited by examiner

*Primary Examiner*—Eileen P. Morgan
(74) *Attorney, Agent, or Firm*—Christie, Parker & Hale, LLP.

(57) ABSTRACT

A pavement cutting and vacuum system is provided that includes a transport vehicle having a holding tank carried thereby; a pavement surface cutting machine having a blade for cutting a pavement surface during a cutting operation; and a vacuum system including a vacuum head connected to the cutting machine and a vacuum hose connecting the vacuum head to the holding tank, such that cuttings created during the cutting operation are transported from the vacuum head to the holding tank by the vacuum system.

20 Claims, 10 Drawing Sheets

PAVEMENT SAW AND VACUUM APPARATUS

CROSS-REFERENCE TO RELATED APPLICATION

This application claims priority to and the benefit of U.S. Provisional Application No. 60/678,248, filed May 3, 2005, the entire content of which is hereby incorporated by reference.

BACKGROUND OF THE INVENTION

This invention relates generally to an improved pavement saw and vacuum system, and more particularly to a vacuum system attached to a pavement saw for automatically transporting pavement cuttings from a saw to a transport vehicle.

Pavement cutting equipment is commonly used to slice sections of concrete and asphalt roadbeds for multiple purposes. For example, the installation of a water main or similar pipeline along an existing street would require cutting a slot in a street bed to permit digging a trench for the pipeline. This is but one example of many such operations used in street construction projects.

The slotting operation is commonly done with a portable diamond circular bladed saw. In order to keep the diamond blade cool during cutting, water is commonly feed around the blade from a tank located on a truck. The concrete or asphalt cuttings for the pavement, which are typically very fine granular particles, mix with the cooling water to form a slurry which remains along the cut as the saw is advanced.

Environmental requirements today require that the cuttings slurry, which can either drain or be washed by rain into public storm drains, be removed from the street during the sawing operation. This is commonly done with a standard shop type wet vacuum. Typically, the sawing operation requires two people, one to operate the saw and one to vacuum the cuttings and empty the vacuum's tank into a larger tank located on a truck for hauling the cuttings to a disposal site. A disadvantage of such a system is that the wet vacuum typically only holds a small amount of cuttings. As such, relatively frequently the wet vacuum becomes full from its collection of cuttings and must be manually taken to and lifted into a collection tank mounted on a truck to empty the collected cuttings.

Accordingly a need exists for a pavement saw and vacuum assembly that simultaneously picks up the cuttings as they are created, and transfers them to a tank located on a transport vehicle for hauling the cuttings to a disposal site. A need also exists for reducing the sawing crew from two people to one person thereby saving considerable cost.

SUMMARY OF THE INVENTION

In one exemplary embodiment of the present invention, a vacuum head is provided for use with a pavement saw, which saw is pivotable about a primary axis to vary a depth of cut relative to a pavement surface. The vacuum head includes a head portion and an outlet portion. The head portion has at least one opening for placement in communication with a pavement surface. The head portion is positionable adjacent a blade of the pavement saw. The outlet portion is in communication with the head portion and connectable to a vacuum hose of a vacuum system. The vacuum head is mountable for pivotal movement about the primary axis.

In another exemplary embodiment, the outlet portion is detachable from the vacuum hose. In yet another exemplary embodiment, the head portion includes two extension arms defining a slot for reception of the blade of the pavement saw therebetween. The extension arms include channels extending from channel openings in the head portion.

In another exemplary embodiment, the head portion includes first and second chambers, and the head portion extends between the first and second chambers to define a passage. The head portion has openings for placement in communication with the pavement surface at the first and second chambers. In yet another exemplary embodiment, the head portion further includes first and second panels extending downwardly from the passage of the vacuum head to form a cavity for a saw blade. In still yet another exemplary embodiment, the first and second panels define an adjustment slot extending upwardly from lower edges of the panels for permitting the blade of the pavement saw to be adjusted.

In another exemplary embodiment, the first and second chambers are fore and aft of the blade of the pavement saw, respectively, and the head portion further comprises side chambers in communication with the first and second chambers. The side chambers are located at the lower edges of the panels and have chamber slots in communication with the pavement surface. In yet another exemplary embodiment, the outlet portion is mountable to the pavement saw for pivotal movement of the vacuum head about the primary axis.

In one exemplary embodiment, a device for cutting a pavement surface includes a pavement saw and vacuum head. The pavement saw pivots about a primary axis of the pavement saw to vary the depth of a cut in the pavement surface. The vacuum head is mounted to the pavement saw for pivotal movement about the primary axis.

In another exemplary embodiment, the saw includes a blade, and the vacuum head is positioned adjacent to the blade. In yet another exemplary embodiment, the saw includes a drive wheel rotatable about the primary axis. In still yet another exemplary embodiment, the vacuum head has at least one opening in communication with the pavement surface.

In another exemplary embodiment, the vacuum hose connects the vacuum head to a holding tank mounted on a transport vehicle.

In one exemplary embodiment, a pavement cutting and vacuum system includes a transport vehicle, a pavement surface cutting machine, and a vacuum system. The transport vehicle includes a holding tank mounted thereon. The pavement surface cutting machine has a blade for cutting a pavement surface during a cutting operation. The vacuum system includes a vacuum head connected to the cutting machine and a vacuum hose extending from the vacuum head to the holding tank, such that cuttings created during the cutting operation are transported from the vacuum head to the holding tank by the vacuum system.

In another exemplary embodiment, the vacuum head includes two extension arms defining a slot for reception of the blade of the pavement saw therebetween, the extension arms including channels extending from channel openings in the nozzle. In yet another exemplary embodiment, a saw blade guard is aligned with the channels to cause the cuttings to drip from the saw blade guard into the channels.

In another exemplary embodiment, the vacuum head is pivotably mounted about a primary axis of the cutting machine. In yet another exemplary embodiment, the saw is pivotable about the primary axis to vary a depth of the cut.

DETAILED DESCRIPTION OF THE INVENTION

As shown in FIGS. 1–16, embodiments of the present invention are directed to a pavement saw and vacuum system. The system simultaneously picks up cuttings, including pavement particles and associated liquid, as they are created in a pavement surface 20 such as a roadway, sidewalk, or other concrete or asphalt structure, and transfers them to a holding tank 22 located on a truck 24 for hauling the cuttings to a disposal site.

Figure 1:
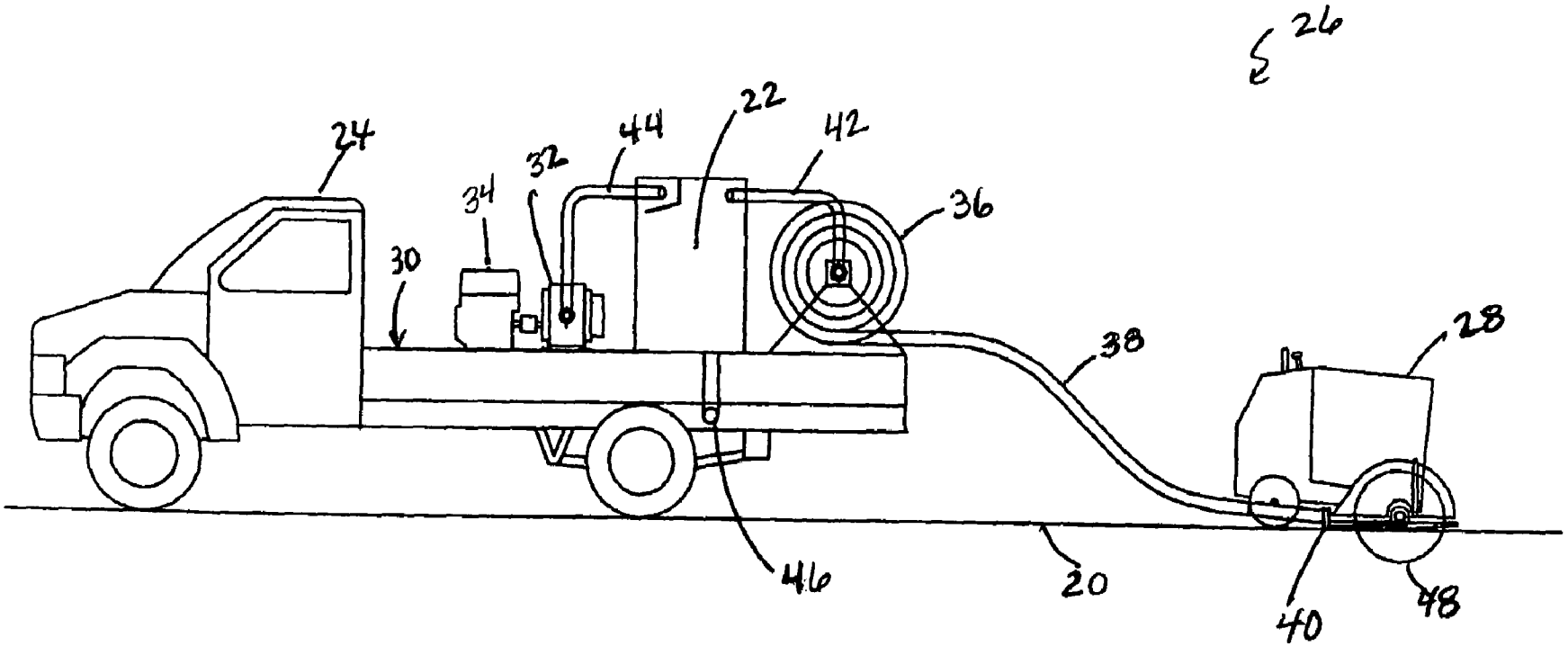
FIG. 1 is a side view of a pavement saw and vacuum system according to an exemplary embodiment of the invention.

As shown in FIG. 1, in one embodiment, the pavement saw and vacuum system 26 includes a construction truck 24, which is typically used to transport a portable saw 28, such as a portable diamond circular bladed saw, to a pavement surface 20 which is to be cut. In one embodiment, the truck 24 is equipped with a lift (not shown) for raising and lowering the saw 28 from a bed 30 of the truck 24.

In the illustrated embodiment, mounted within the truck bed 30 is the holding tank 22 for receiving the cuttings, a vacuum pump 32 driven by an engine 34, and a vacuum hose reel 36. A vacuum hose 38 is connected at one end to a vacuum head 40 and at another end to the holding tank 22 through a vacuum line 42. The vacuum pump 32 is connected to the holding tank 22 through a vacuum line 44. The holding tank 22 is fitted with a drain line 46 to empty the tank 22. Not shown is a drain valve used to open or close the drain line 46.

In one embodiment, the saw 28 is equipped with a diamond saw blade 48. Typical saws used for pavement cutting operations are self-propelled, i.e., propelled by their own engines, and an operator controls the saw's forward direction and depth of cut with controls mounted on the saw. Such saws are sometimes referred to as walk-behind saws. Typical saws also include means for cooling the saw blade 48; for example, a coolant liquid such as water may sprayed directly onto the saw blade 48 during the cutting operation. The coolant source may be stored on the truck 24 and pumped through a coolant line to the saw blade 48, as is known in the art.

Figure 2:
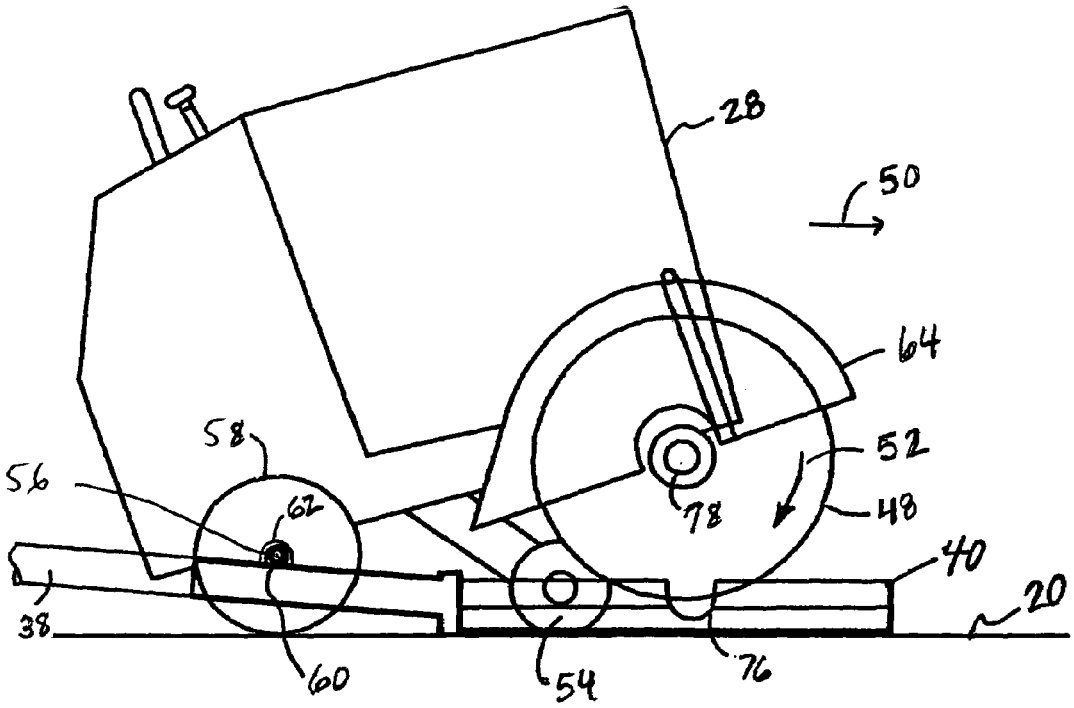
FIG. 2 is an enlarged side view of a pavement saw from the system of FIG. 1, shown in a raised position and having a vacuum head 4 attached thereto.
Figure 3:
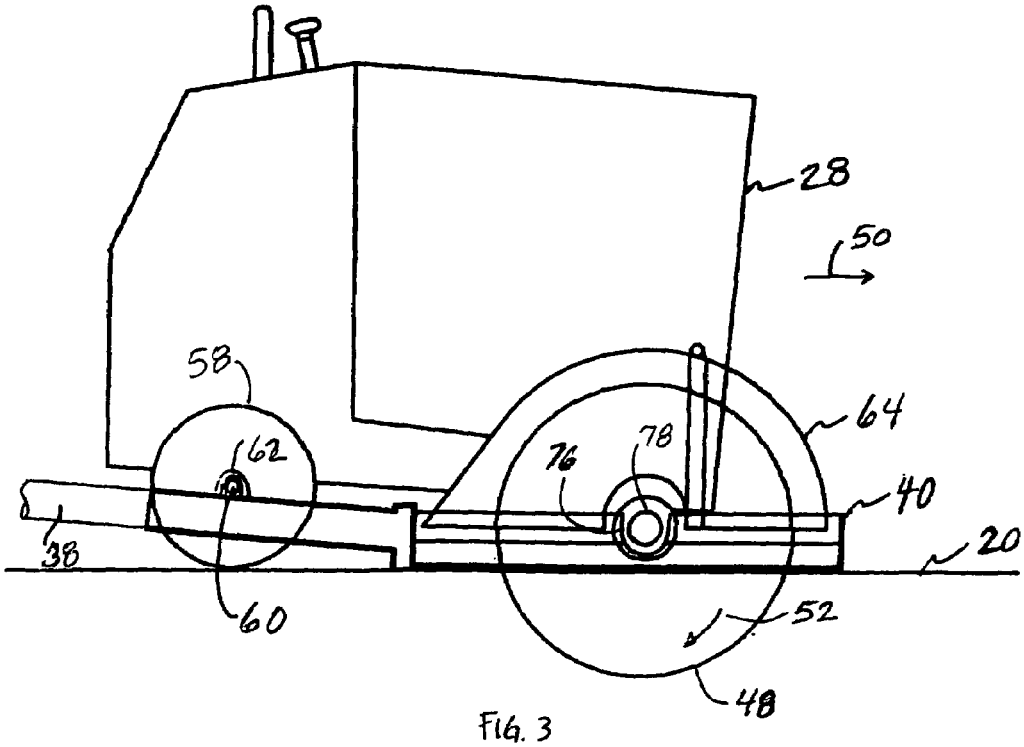
FIG. 3 is a side view of the pavement saw of FIG. 2, shown in a lowered or cutting position.

FIGS. 2 and 3 illustrate the vacuum head 40 in position on the saw 28, with FIG. 2 showing the saw 28 in a raised position prior to starting a cutting operation, and FIG. 3 showing the saw 28 during a cutting operation. When viewed as shown in FIGS. 2 and 3, during a cutting operation the saw 28 travels from left to right as shown by arrow 50, and the blade 48 rotates in a clockwise direction as shown by arrow 52. The depth of the cut created by the saw blade 48 is determined by how far the saw blade 48 extends into the pavement surface 20, and is different for different pavement conditions and types of cutting operations. The height of the saw blade 48 is controlled by a set of wheels 54 that retract and extend, as desired, to lower or raise the saw blade 48. This results in the saw pivoting about a "primary axis" 56 corresponding to the axis of a drive wheel 58 to vary the depth of the cut relative to the pavement surface. The drive wheel 58 propels the saw 28 forward in order to perform the cutting operation.

Figure 4:
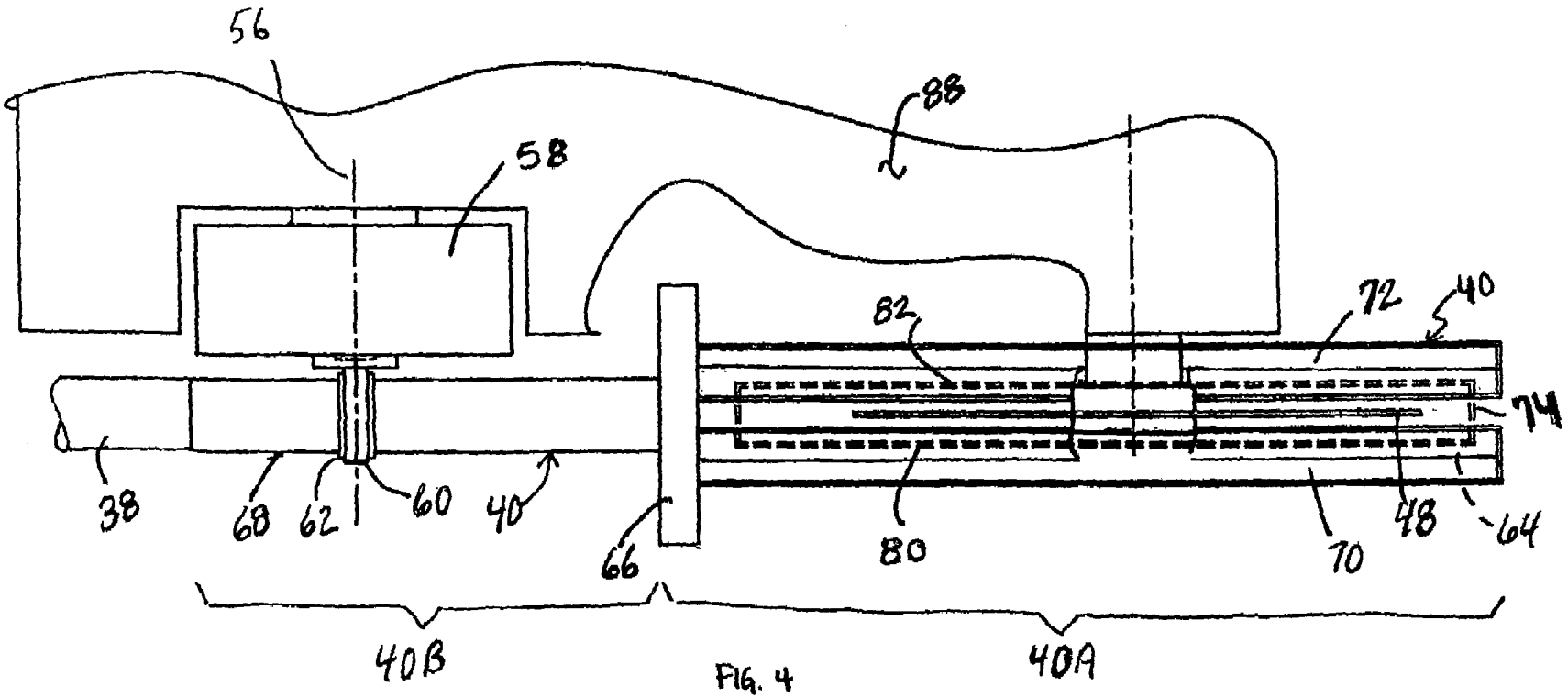
FIG. 4 is a top view showing a connection of the vacuum head of FIG. 2 to the pavement saw of FIG. 2.

In one embodiment, as shown in FIGS. 2–4, the vacuum head 40 is pivotably mounted to an axle 60 of the drive wheel 58 via a mounting boss 62 having an opening 64 (see FIGS. 5 and 6) which receives the axle 60. A bracket (not shown) or another suitable attachment device secures the mounting boss 62 to the axle 60 in a manner allowing rotational movement of the vacuum head 40 with respect to the primary axis 56. The gravitational force on the vacuum head 40 thus causes the vacuum head 40 to always remain flat on the pavement surface 20 regardless of the saw blade's 48 position in the cut, and regardless of the slope of the pavement surface 20. This free rotational connection, which may take any suitable form enabling the vacuum head 40 to pivot substantially about the primary axis 56 of the drive wheel 58, permits the vacuum head 40 to remain flat with the pavement surface 20 regardless of the depth of the cut created by the saw blade 48.

As also shown in FIGS. 2 and 3, the saw blade 48 is customarily protected by a blade guard 64. When the saw blade 48 rotates and cuts into the pavement surface 20, some of the cuttings tend to spray out of the cut and up into the guard 64. As shown by viewing FIGS. 3 and 4 together, when the saw blade 48 is in a cutting position the vacuum head 40 extends in surrounding relation to the guard 64 (shown in broken lines in FIG. 4) in order to collect this cutting overspray.

As shown in FIG. 4, the vacuum head 40 includes an outlet portion 40B and a head portion 40A positioned adjacent the saw blade 48. A vacuum nozzle 66 of the head portion 40A vacuums the cuttings off of the pavement surface 20 as the surface is cut by the saw 28. As also shown in FIG. 4, attached to one end of the vacuum nozzle 66 is an outlet tube 68 of the outlet portion 40B. Attached to another end of the vacuum nozzle are two extension arms 70 and 72 (see also FIGS. 5–7) separated by a slot 74, which receives the saw blade 48 between the extension arms during a cutting operation. Each extension arm 70 and 72 may also include a cutout 76 for allowing a shaft 78 of the saw blade 48 (see FIG. 2) to extend therefrom.

As shown in FIGS. 3 and 4, the extension arms 70 and 72 are located directly under edges 80 and 82 of the blade guard 64 (seen in phantom in FIG. 4). This permits the cutting overspray that tends to collect inside the blade guard 64 to drip from the guard edges 80 and 82 and into the extension arms 70 and 72 of the vacuum head 40. As also shown in FIG. 4, in one embodiment, the mounting boss 62 of the vacuum head 40 is located on the outlet tube 68, which in turn is connected to the vacuum hose 38, allowing cuttings collected from the vacuum head 40 to be transported to the holding tank 22 of the truck 24.

Figure 5:
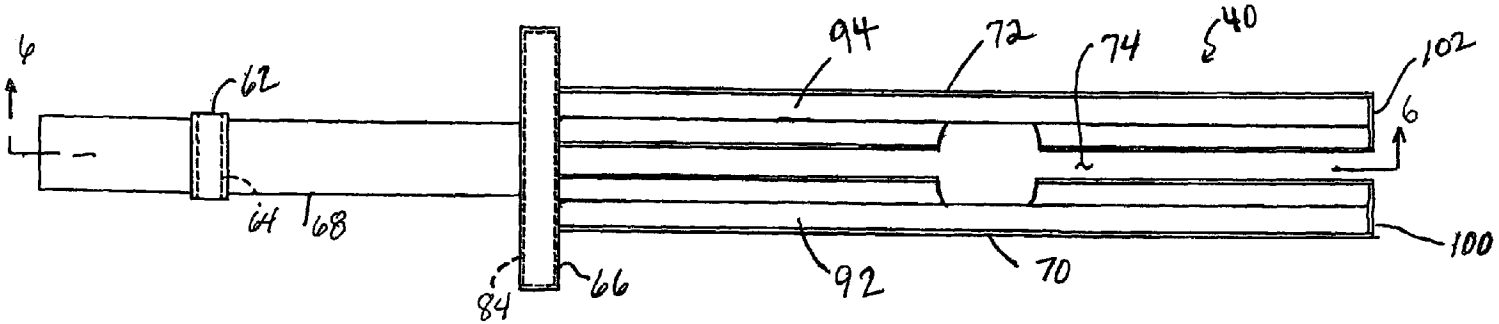
FIG. 5 is a top view of the vacuum head of FIG. 2.
Figure 6:
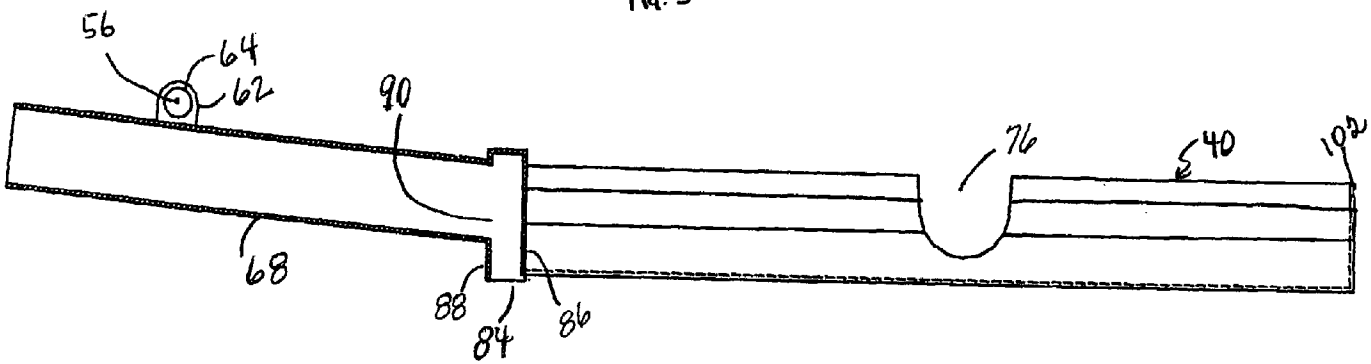
FIG. 6 is a cross-sectional view taken from line 6—6 of FIG. 5.

As shown in FIGS. 5 and 6, the vacuum nozzle 66 of the vacuum head 40 includes an open bottom end 84 for vacuuming up the cuttings, including pavement material and associated liquids, that collect behind the saw blade 48 during a cutting operation. As shown in FIG. 6, a leading edge plate 86 of the vacuum nozzle 66 is slightly raised with respect to a trailing edge plate 88 of the vacuum nozzle 66 such that a gap is formed between the pavement surface 20 and the vacuum nozzle 66 to facilitate suction of cuttings into the vacuum nozzle 66 during a cutting operation.

Figure 7:
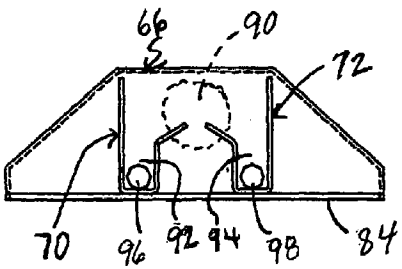
FIG. 7 is an end view of the vacuum head of FIG. 2.

As shown in FIG. 7, the outlet tube 68 includes an open end 90 connected to the vacuum nozzle 66 to create a suction passageway therebetween. As shown in FIGS. 5 and 7, each extension arm 70 and 72 of the vacuum head 40 forms a channel 92 and 94 leading to an opening 96 and 98 in the leading edge plate 86 of the vacuum nozzle 66. This causes the overspray cuttings to drip from the saw guard 64, collect in the extension arms 70 and 72, drain down the extension arm channels 92 and 94 and become suctioned into the outlet tube 68 through the openings 96 and 98 in the vacuum nozzle 66. The channels 92 and 94 may be terminate at end walls 100 and 102 at a distal end of the extension arms 70 and 72, as shown in FIGS. 5 and 6. Alternatively, as shown in FIG. 7, the extension arms 70 and 72 may be open at a distal end.

Once the cuttings enter the outlet tube 68, either via the open end 84 of the vacuum nozzle 66 or via the extension arms 70 and 72 and the vacuum nozzle openings 25 and 26 adjacent thereto, the cuttings are drawn through the vacuum hose 38 and vacuum line 42 and into the holding tank 22 in the truck 1. The cuttings collected in the holding tank 22 may then be transported by the truck to a disposed site and disposed of through drain line 46.

Figure 10:
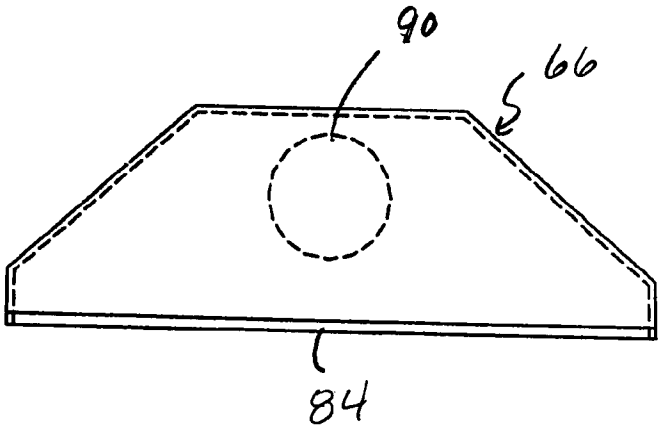
FIG. 10 is an end view of the vacuum head of FIG. 8.
Figure 8:
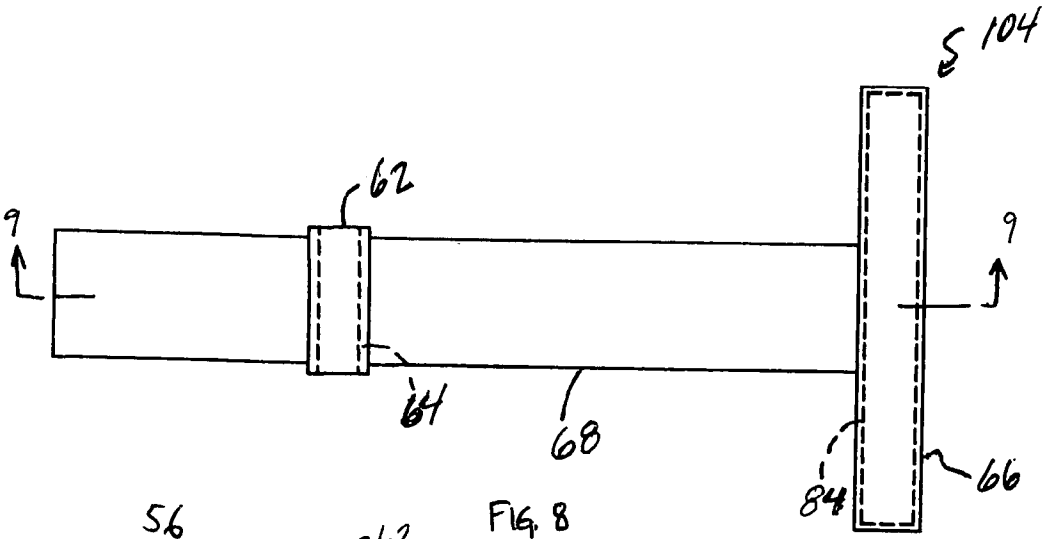
FIG. 8 is a top view of a vacuum head according to another embodiment of the invention.
Figure 9:
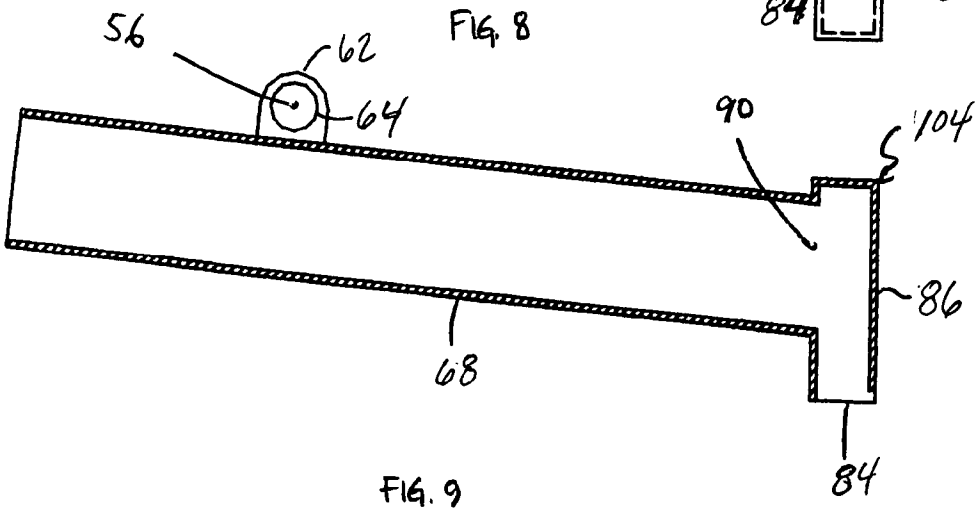
FIG. 9 is a cross-sectional view taken from line 9—9 of FIG. 8.

FIGS. 8–10, show a vacuum head 104 according to another embodiment of the invention. When a cutting operation is performed on a level pavement surface, the extension arms 70 and 72 are not necessary and hence can be omitted as is shown in the embodiment of FIGS. 8–10. As such, the vacuum head 104 in the embodiment of FIGS. 8–10 includes the same elements described above with respect to the vacuum head 4 of FIGS. 1–7, but without the extension arms 70 and 72.

However, many pavement surfaces slope toward the edges of the pavement to permit draining. In such conditions, cuttings and overspray from the blade guard 64 tend to drain toward the edges of the pavement and miss the vacuum nozzle 66 which is directly behind the saw 28. The same problem exists when cutting a downhill pavement surface, as required in some cases. The overspray cuttings in such a case tend to run away from the saw 28 at a rate faster than the vacuum head 40 and saw 28 advance. In such situations the extension arms 70 and 72 are advantageous for preventing the cuttings and overspray from missing the vacuum nozzle 66.

Figure 11:
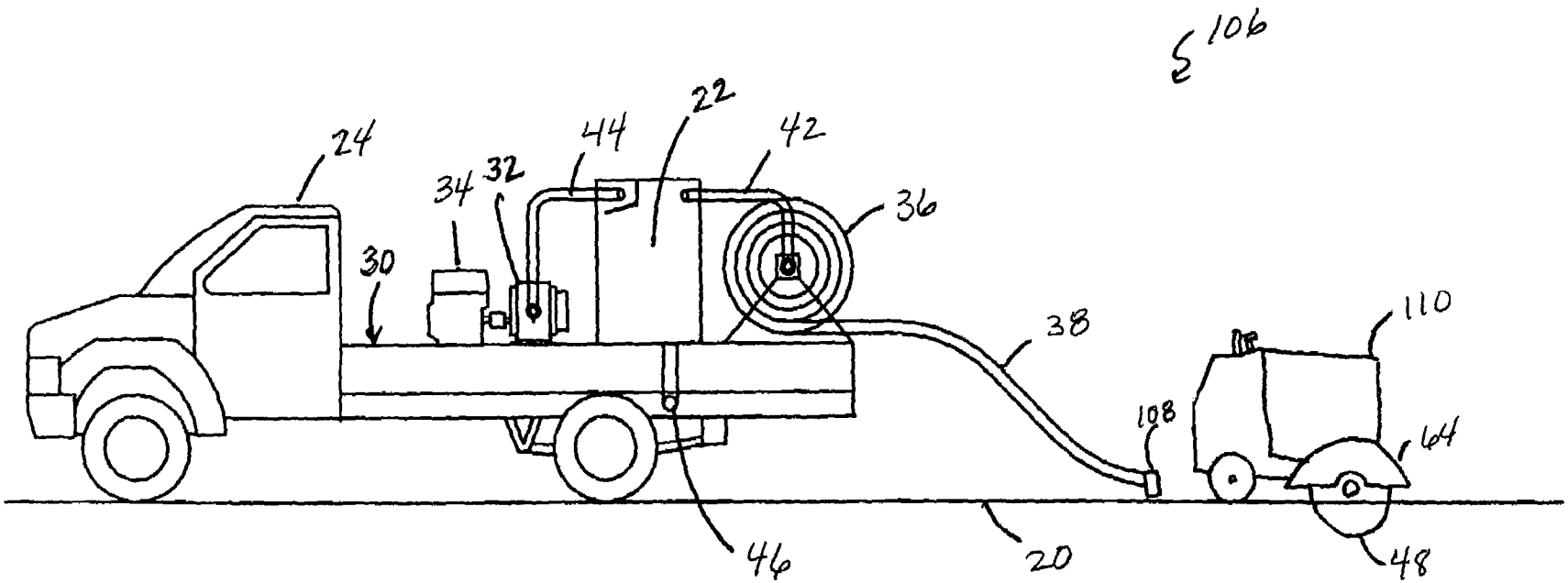
FIG. 11 is a side view of a pavement saw and vacuum system according to another embodiment of the invention.

In the embodiment of FIG. 11, the pavement saw and vacuum system 106 includes a vacuum system and vacuum head 108 that is not connected to a saw 110. However, such a system is still advantageous because the vacuum head 108 is connected to the vacuum hose 38, the vacuum line 42 and the holding tank 22 in the truck 24 as described above with respect to FIG. 1. As such, even with the vacuum head 108 detached from the saw 110, cuttings collected by the vacuum head 108 are vacuumed directly into the holding tank 22 in the truck 24 without the need for manually transporting the cuttings thereto.

Figure 12:
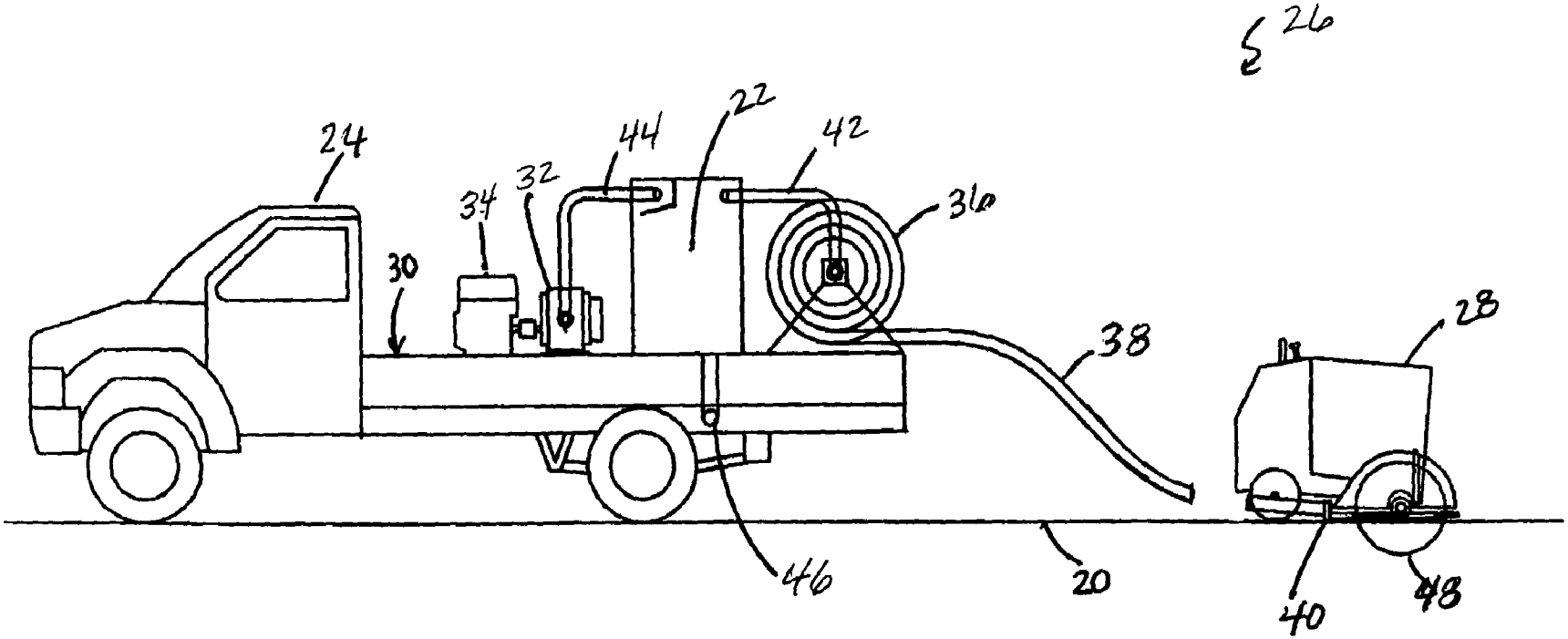
FIG. 12 is a side view of a pavement saw and vacuum system according to yet another embodiment of the invention

In the embodiment of FIG. 12, the hose 38 may be detached from the head, and be used to vacuum the surrounding area. For example, the hose 38 may be temporarily detachable from the outlet tube 68 (see FIG. 4). The hose detachment capability may be similar to any found in industrial or residential applications. Detachment of the hose 38 from the head 40 allows an operator to vacuum surrounding areas of the pavement in addition to the cuttings formed by the cutting operation. The detached hose may also be used after or before a cutting operation to clear the area of unwanted debris or cuttings. A separate nozzle (not shown) may be attached to the end of the vacuum hose 38 to facilitate pickup of debris.

Figure 13:
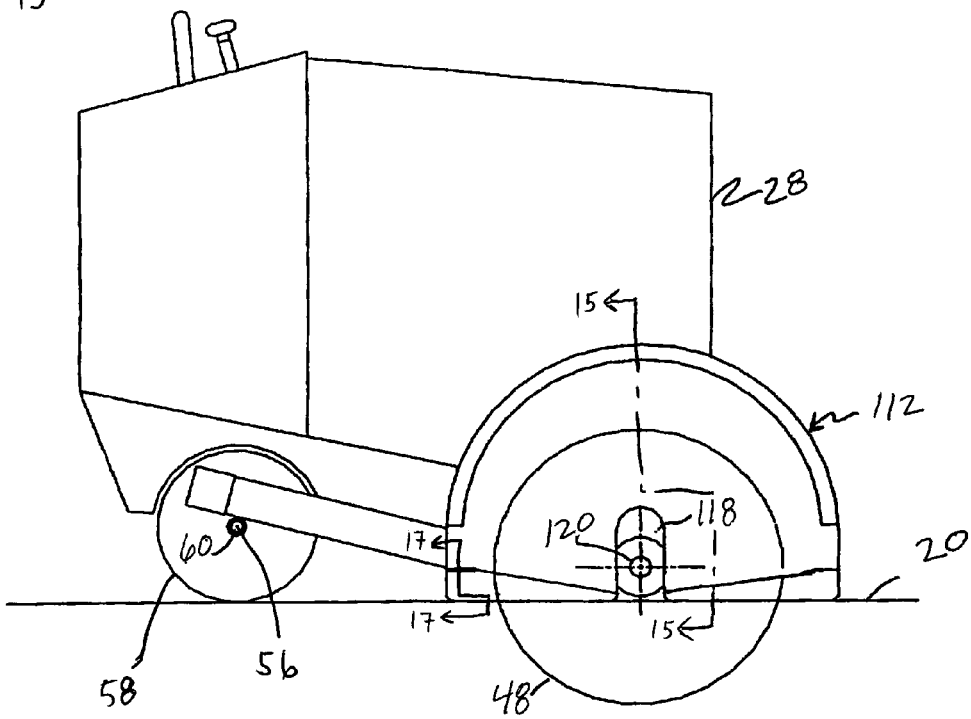
FIG. 13 is a side view of a pavement saw according to a further exemplary embodiment of the present invention.
Figure 14:
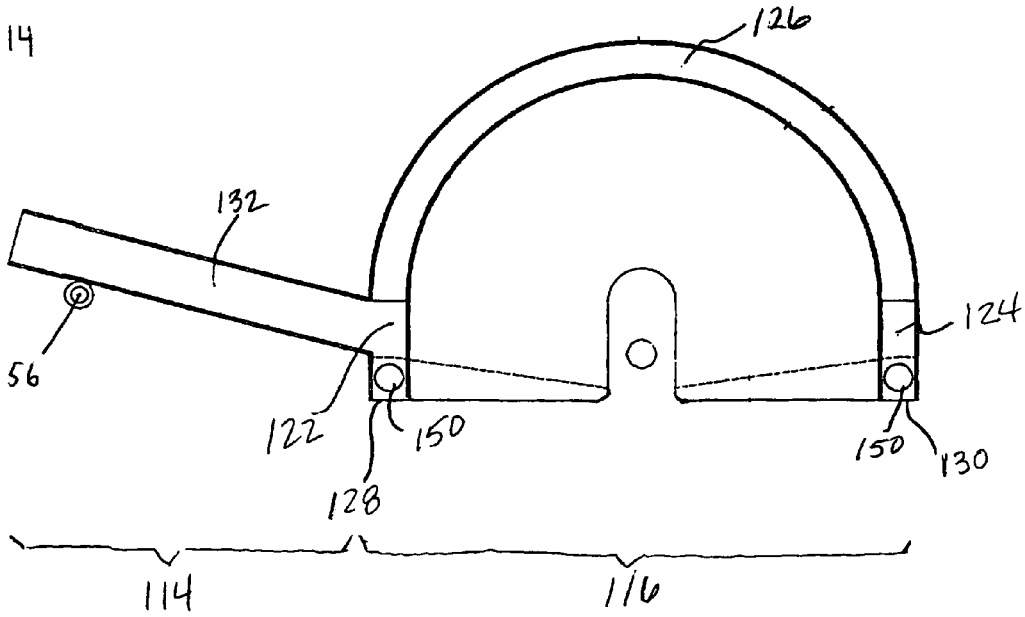
FIG. 14 is a longitudinal cross-sectional view of a vacuum head of the pavement saw of FIG. 13.

FIGS. 13–17 illustrate another embodiment according to the present invention. As shown in FIGS. 13 and 14, a vacuum head 112 includes a outlet portion 114 and a head portion 116 positioned adjacent the saw blade 48. The head portion includes a substantially vertical slot 118 in which a saw blade shaft 120 can move as the saw blade 48 and shaft 120 pivot about the axle 60 of the drive wheel 58, thereby adjusting the position of the saw blade 48 relative to the pavement surface 20 according to the depth of the cut desired. The vacuum head 112 is mounted pivotal to the axle 60 of the drive wheel 58 such that it remains parallel to the pavement surface 20. As shown in FIG. 14, the head portion 116 of the vacuum head 112 includes first and second chambers, which may be referred to here as plenum chambers, 122 and 124, located fore and aft of the blade 48, respectively. A passage 126 extends from the first chamber 122 circumferentially around the saw blade 48 to connect the two plenum chambers together. The second chamber 124 is located at a distal end of the vacuum head 112. An opening 128 in the vacuum head 112 located at the first chamber 122 is in communication with the pavement surface 20 to provide suction for cuttings from the pavement saw. A similar opening 130 located at the second chamber 124 is in communication with the pavement surface 20. Cuttings vacuumed into the second chamber 124 via the opening 130 are transported through the passage 126 to the first chamber 122, and cuttings found therein are transferred through an outlet tube 132 to the holding tank 22 (see FIG. 1), as described above.

Figure 15:
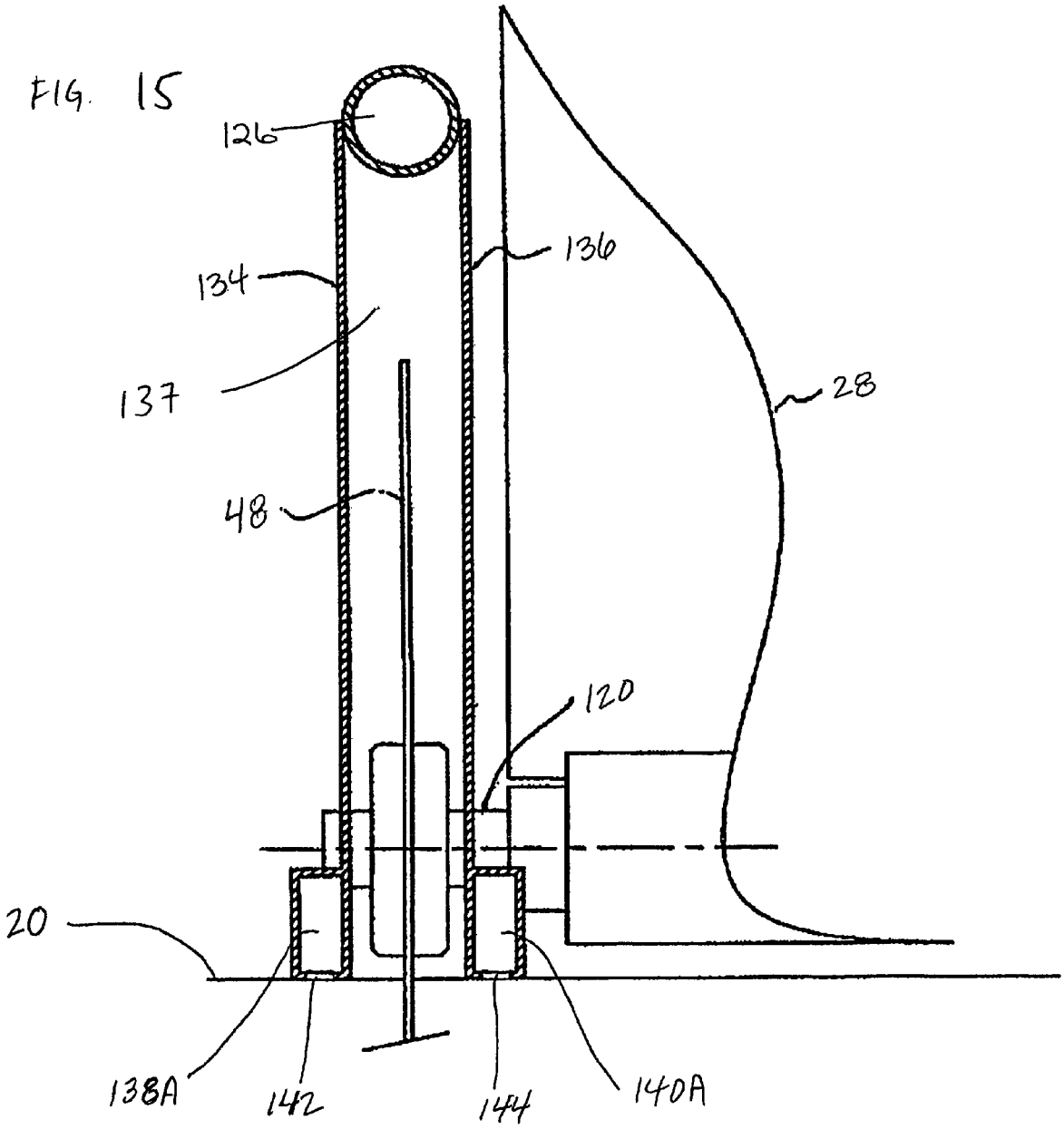
FIG. 15 is a cross-sectional view of the vacuum head taken from line 15—15 of FIG. 13.

As shown in FIG. 15, panels 134 and 136 extend downwardly from the passage 126 to define a cavity 137 in which the saw blade 48 is located. The panels 134 and 136 may, for example, be welded to the structure defining the passage 126. The panels 134 and 136, as well as the structure defining the passage 126, act as a saw blade guard for collecting the overspray, as well as channelling cuttings generated by the saw onto the pavement surface 20, where the cuttings can be captured by the vacuum head, as described herein.

Figure 17:
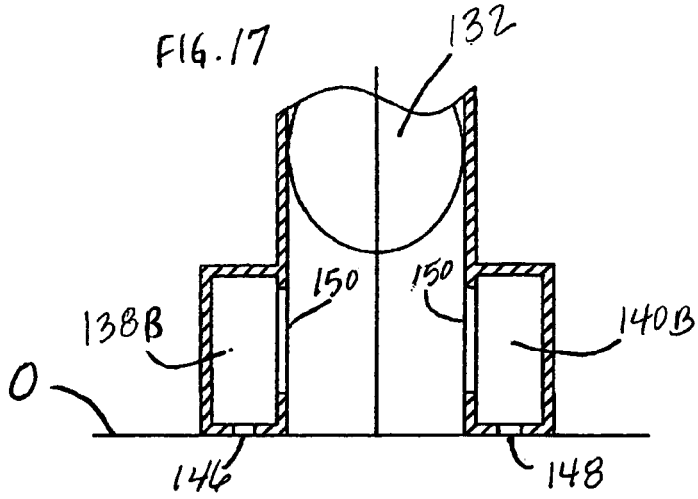
FIG. 17 is a cross-sectional view of the vacuum head taken from the line 17—17 of FIG. 13.
Figure 16:
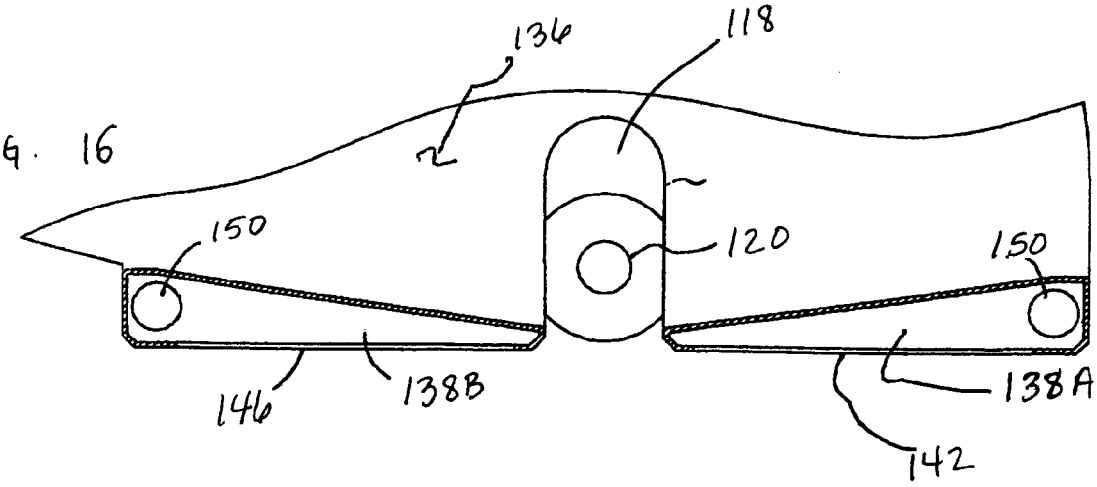
FIG. 16 is another longitudinal cross-sectional view of the vacuum head of the pavement saw of FIG. 13.

As shown in FIGS. 15–17, four side chambers, sometimes called plenum chambers, 138A, 138B, 140A, and 140B may be located at a lower edge of the panels 134 and 136 and extend away from the saw blade 48. The side chambers may be welded to the panels 134 and 136, for example. As shown in FIGS. 15 and 16, side chambers 138A and 140A extend from near the vertical slot 118 to the second chamber 124 at the distal end of the vacuum head 112. Slots 142 and 144 in bottom portions of the side chambers 138A and 140A, respectively, are placed in communication with the pavement surface 20. As shown in FIGS. 16 and 17, side chambers 138B and 140B extend from near the vertical slot 118 to the first chamber 122. Slots 146 and 148 in a bottom portion of the side chambers 138B and 140B, respectively, are placed in communication with the pavement surface 20. Openings 150 are placed between the side chambers 138A, 138B, 140A, and 140B and the first and second chambers 122 and 124, allowing communication of the vacuum suction to the slots 142, 144, 146, and 148. Cuttings from the pavement surface which are vacuumed into the side chambers via the slots 142, 144, 146, and 148 are then transferred into first and second chambers 122 and 124 via the openings 150. The cuttings and liquid are then transferred through the outlet tube 132 to the holding tank 22 (see FIG. 1), as described above.

Generally, the majority of cuttings are picked up by the first chamber 122, with the second chamber 124 picking up most of the overspray of cooling water that spins around the saw blade. The slots 142, 144, 146, and 148 pick up the overspray that drains off the inside of the panels 134 and 136. The slots 142, 144, 146, and 148 are configured to restrict the path of vacuum which increases the vacuum force and aids the picking up of saw cuttings. Proximity of the slots and openings to the pavement surface 20 also restricts the path flow of outside air into the vacuum head to similar effect.

The preceding description has been presented with reference to various embodiments of the invention. Persons skilled in the art and technology to which this invention pertains will appreciate that alterations and changes may be made within the scope of the appended claims. Alterations and changes in the described structures and methods of operation can be practiced without meaningfully departing from the principle, spirit and scope of this invention.

What is claimed is:

1. A vacuum head for use with a pavement saw, which saw is rotationally pivotable about a primary axis to vary a depth of a cut relative to a pavement surface, the vacuum head comprising:

a head portion having at least one opening for placement in communication with a pavement surface, the head portion being positionable adjacent a blade of the pavement saw; and an outlet portion in communication with the head portion and connectable to a vacuum hose of a vacuum system;

wherein the vacuum head is separately mountable along the primary axis such that said vacuum head rotationally pivots about the primary axis independent of the movement of the saw.

2. The vacuum head of claim 1, wherein the outlet portion is detachable from the vacuum hose.

3. The vacuum head of claim 1, wherein the head portion includes two extension arms defining a slot for reception of the blade of the pavement saw therebetween, the extension arms comprising channels extending from channel openings in the head portion.

4. The vacuum head of claim 1, wherein the head portion comprises first and second chambers, the head portion extending between the first and second chambers to define a passage, and wherein the head portion has openings for placement in communication with the pavement surface at the first and second chambers.

5. The vacuum head of claim 4, wherein the head portion further comprises first and second panels extending downwardly from the passage of the vacuum head to form a cavity for the blade of the pavement saw.

6. The vacuum head of claim 5, wherein the first and second panels define an adjustment slot extending upwardly from lower edges of the panels for permitting the blade of the pavement saw to be adjusted.

7. The vacuum head of claim 6, wherein:

the first and second chambers are fore and aft of the blade of the pavement saw, respectively; and the head portion further comprises side chambers in communication with the first and second chambers, the side chambers being located at the lower edges of the panels and having chamber slots in communication with the pavement surface.

8. The vacuum head of claim 1, wherein the vacuum head is pivotally mounted to the pavement saw through the outlet portion.

9. A device for culling a pavement surface, the device comprising:

a pavement saw including at least a drive wheel and a saw blade mounted on at least one drive wheel that defines a primary axis, the pavement saw being rotationally pivotable about the primary axis to vary the depth of a cut in the pavement surface; and a vacuum head separately mounted along the primary axis of the pavement saw such that the vacuum head pivots about the primary axis independent of the movement of the pavement saw.

10. The device of claim 9, wherein the vacuum head is positioned adjacent to the saw blade.

11. The device of claim 9, wherein the primary axis is defined by the axle of the drive wheel.

12. The device of claim 9, wherein the vacuum head has at least one opening in communication with the pavement surface.

13. The device of claim 9, wherein the vacuum head is connectable to and detachable from a vacuum hose.

14. The device of claim 9, further comprising:

a transport vehicle comprising a holding tank mounted thereon; and a vacuum hose extending from the vacuum head to the holding tank, such that cuttings created during the cutting operation are transported from the vacuum head to the holding tank by the vacuum system.

15. The device of claim 14, wherein the vacuum head comprises a nozzle having an opening in communication with the pavement surface.

16. The device of claim 15, wherein the vacuum head includes two extension arms extending from the nozzle and defining a slot for reception of the blade for cutting the pavement surface therebetween, the extension arms comprising channels extending from channel openings in the nozzle.

17. The device of claim 16 and further comprising a saw blade guard aligned with the channels to cause the cuttings to drip from the saw blade guard into the channels.

18. The device of claim 14, wherein the vacuum head comprises first and second chambers, the vacuum head extending between the first and second chambers to define a passage, and wherein the vacuum head has openings in communication with the pavement surface at the first and second chambers.

19. The device of claim 18, wherein the vacuum head further comprises first and second panels extending downwardly from the passage of the vacuum head to form a cavity for a saw blade.

20. The device of claim 19, wherein the vacuum head further comprises side chambers in communication with the first and second chambers, the side chambers being located at the lower edges of the first and second panels and having chamber slots in communication with the pavement surface.

* * * * *